United States Patent [19]

Baldwin et al.

[11] Patent Number: 4,595,558

[45] Date of Patent: Jun. 17, 1986

[54] ADDITIVE AGENTS FOR USE IN THE MANUFACTURE OF MOLDED PARTICULATE METAL ARTICLES

[75] Inventors: Roger A. Baldwin, Warr Acres; Jim W. Kauffman; William C. Laughlin, both of Edmond, all of Okla.

[73] Assignee: Kerr-McGee Chemical Corporation, Oklahoma City, Okla.

[21] Appl. No.: 735,100

[22] Filed: May 17, 1985

[51] Int. Cl.[4] ..... B22F 3/14

[52] U.S. Cl. ..... 419/66; 419/69; 419/23; 419/36

[58] Field of Search ..... 419/36, 37, 66, 69, 419/23

[56] References Cited

U.S. PATENT DOCUMENTS 3,592,637 7/1971 Brown et al. ..... 75/135
4,158,688 6/1979 Pett et al. ..... 419/37
4,158,689 6/1979 Pett et al. ..... 419/36
4,455,354 6/1984 Dillon et al. ..... 419/17

OTHER PUBLICATIONS

Kirk-Othmer, Encyclopedia of Chemical Technology, vol. 10 pp. 654–659, 2ed. (1966).

*Primary Examiner*—Stephen J. Lechert, Jr.
*Attorney, Agent, or Firm*—William G. Addison; John P. Ward

[57] ABSTRACT

Broadly, the present invention provides for improvements in the manufacture of compacted or molded articles of blended mixtures of additive metals for use in the preparation of alloys of base metals. The improvements comprise the addition to blended mixtures of additive metals of at least one processing aid comprising at least one polyglycol or a derivative thereof to the blended mixture of metals in a stabilizing and lubricating amount.

7 Claims, No Drawings

ADDITIVE AGENTS FOR USE IN THE MANUFACTURE OF MOLDED PARTICULATE METAL ARTICLES

FIELD OF THE INVENTION

The present invention relates to improvements in processes for the manufacture of molded articles of blends of additive metals for use in preparing alloyed base metals. More particularly, the present invention relates to a group of stabilizing and lubricating processing aids, for use in the manufacture of said molded articles.

BACKGROUND OF THE INVENTION

It is known in the metallurgical industry to introduce solid metal additives to baths of molten base metals to provide alloyed compositions thereof having mechanical and chemical properties different from those of the base metals alone. For example, it is known to add manganese to molten aluminum in the form of a manganese-aluminum alloy to provide increased strength to wrought aluminum products produced therefrom. Other additive metals which have been utilized in the metallurgical industry to modify the mechanical and chemical properties of a variety of base metal include chromium, tungsten, molybdenum, vanadium, iron, cobalt, copper, nickel and the like.

It has been common practice to introduce these solid metl additives into baths of molten base metals in the form of solid preformed alloys of said metal additives and the base metals. However, the use of such solid preformed alloys has not been entirely satisfactory. For example, a solid preformed alloy of an additive and base metal is relatively expensive to produce. In addition, such a preformed alloy is quite often characterized by a poor dissolving rate and a tendency to cause a large and highly undesirable temperature drop in the bath of molten base metal to which it is added. To overcome these drawbacks it has been proposed to introduce the desired metal additive into the bath of molten base metal to be treated in the form of an uncompacted or compacted blended mixture of the additive and base metal. See, for example, U.S. Pat. No. 3,592,637. According to the disclosures in this patent, the blended mixtures comprise a "principal material", i.e., the additive metal desired to be alloyed with a base metal in a molten bath of the latter to modify some particular property thereof, and a "solution promoter" material which generally consists of the base metal itself. The advantages of using blended mixtures for making metal additions to baths of molten base metals rather than the previously employed preformed alloys thereof are disclosed as including better economics, faster dissolving rates for the additive metal, and little or no tendency of the blended mixtures to cause temperature drops in the bath of molten base metal upon their addition thereto.

Further, in accordance with said U.S. Pat. No. 3,592,637, it is disclosed that the blended mixtures of two or more finely divided metals can be added to the bath of molten base metal in the form of either uncompacted confined mixtures or as pressed compacts or pellets. In this regard, the patent still further discloses that the form most preferred is that of pressed compacts or pellets. However, in preparing pressed compacts or pellets of the above described blended mixtures, at least two problems are encountered. One is that during the compacting operation the metals comprising the blended mixture have a tendency to segregate one from the other such that the resultant compact or pellet is not of uniform distribution. The second problem is associated with the abrasive characteristics of the blended mixture and the resultant damage that such abrasive characteristic has on process equipment during the forming of said compressed compacts or pellets.

To overcome the above described problems, practice has been to add a processing aid, such as mineral oil, to the blended mixture of metals. However, while the addition of mineral oil to the blended mixture of metals does improve the processibility of the mixture, the use of mineral oil has not been entirely satisfactory. For example, experience has shown that when compacted or molded articles of blended mixtures of metals containing mineral oil are added to baths of molten base metal, the mineral oil readily undergoes decomposition with the generation of flames and the formation of dense black smoke. Neither flame generation nor smoke formation is desirable from a safety and environmental standpoint. Therefore, a need exists for a different group of processing aids which does not exhibit the undesirable characteristics of mineral oil but does exhibit a desirable characteristic thereof, namely the characteristic of not adversely affecting the dissolution rate of the blended mixture when added to the bath of molten base metal.

SUMMARY OF THE INVENTION

Broadly stated, the present invention relates to improvements in a process for the manufacture of compacted or molded articles of blended mixtures of additive metals for use in preparing alloys of base metals. The process to which the improvements of the present invention relate includes the steps of providing a blended mixture of at least two different finely divided metals, one of said metals being an additive metal and the other being the base metal, introducing said blended mixture into a mold and then subjecting said blended mixture of said mold to a pressure sufficient to compress the blended mixture in the mold into a compacted or molded article.

In particular, the improvements of the present invention comprise providing at least one processing aid selected from the group consisting of polyglycol materials and derivatives thereof and admixing a stabilizing and lubricating amount of said processing aid with the blended mixture of an additive metal and a base metal prior to the forming of said blended mixture into a compacted or molded article.

DETAILED DESCRIPTION OF THE INVENTION

The present invention provides a means for substantially reducing the problems previously encountered during the manufacture of compacted or molded articles from blended mixtures such as those disclosed in U.S. Pat. No. 3,592,637. As discussed above, in the manufacture of compacted or molded articles of blended mixtures of at least two finely divided metals, one being an additive metal and the other being the base metal, at least two problems are encountered. One is the tendency of the individual metals in the blended mixture to separate one from the other during the mixing, handling and molding steps and the other is the tendency of the blended mixtures to cause, through abrasion, substantial deterioration of the molds themselves within relatively short periods of time. Also, as discussed above, when mineral oil has been employed to reduce or substantially eliminate these problems, the mineral oil itself has given rise to additional problems which are undesirable.

It now has been discovered that these various problems, both those associated with the blended mixtures of metals as well as those associated with the use of mineral oil can significantly be reduced if, when preparing the blended mixtures of the two finely divided metals, there is added to said blended mixture a stabilizing and lubricating amount of at least one processing agent as defined by the general formula set forth immediately below. As employed throughout this description and appended claims, the term "processing aid" means any material corresponding to the following general formula and possessing the ability to impart both improved stability and lubricating properties to the blended mixtures herein disclosed.

The processing aids useful in the improved process of this invention are those materials selected from the group consisting of polyglycols and derivatives thereof corresponding to the general formula:

$$RO(R^2O)_nR^1$$

wherein each of R and $R_1$ individually is hydrogen or a monovalent hydrocarbon radical selected from straight and branched-chain lower alkyl radicals and the radical $R^3CO$-where $R^3$ is a straight or branched-chain lower alkyl radical. The term "lower alkyl radical" as used throughout this specification and appended claims means a monovalent hydrocarbon radical containing from one to about six carbon atoms and preferably from one to about four carbon atoms. R and $R^1$ may or may not be the same, although in a preferred embodiment of this invention, they will be the same. $R_2$ in the above formula comprises a divalent alkylene radical containing from two to four carbon atoms, preferably the divalent radicals $—CH_2CH_2—$ and $—CH(CH_3)CH_2—$ and n is a number ranging from 2 to about 20.

As disclosed above, the processing aids which are useful in the improved process of the present invention are those materials corresponding to the above defined general formula. This general formula defines a group of compounds consisting of polyglycols and derivatives of said polyglycols including ethers, esters and mixed ether-esters. These compounds can be employed alone or in various combinations. Representative, but nonlimiting, examples of the polyglycols and their derivatives which can be employed in this invention include diethylene glycol, dipropylene glycol, dibutylene glycol, diethylene glycol methyl ether, diethylene glycol butyl ether, diethylene glycol dibutyl ether, dipropylene glycol methyl ether, diethylene glycol methyl ether acetate, dibutylene glycol butyl ether acetate, diethylene glycol diacetate and the like and higher molecular weight liquid polyglycols prepared from ethylene glycol, propylene glycol and the like and mixtures thereof.

Particularly preferred processing aids for use in the practice of this invention are those commercially available, higher molecular weight liquid polyglycols having number average molecular weights above about 200, i.e., where n in the above formula is equal to or greater than about 4. These commercially available liquid polyglycols actually are mixtures containing many polyglycol species of varying chain lengths. For example, Carbowax 400 and Carbowax 600 sold by Union Carbide Corporation are mixtures of polyethylene glycol species where n ranges from about 2 to about 15 and from 3 to about 18, respectively. Other preferred higher molecular weight liquid polyglycols are the commercially available polypropylene glycols. For a complete description of the higher molecular weight liquid polyglycols useful in the practice of this invention, reference is made to the description found in *Kirk-Othmer, Encyclopedia of Chemical Technology,* Vol. 10, pages 654–659, 2ed. (1966) which description is incorporated herein in its entirety.

The processing aids described and illustrated herein and corresponding to the above formula are added to the blended mixture of at least two finely divided metals in an amount sufficient to stabilize the blended mixture against segregation and to impart a degree of lubricity to the blended mixture to significantly reduce abrasion of the molds by the metals in the blended mixture during the formation of the compacted or molded articles formed from said blended mixtures.

In general, the amount of the processing aids corresponding to the above formula and employed in said blended mixtures of at least two finely divided metals will range from about 0.1 to about 5.0 weight percent based upon 100 parts by weight of the final mixture. A more preferred range for the processing aids corresponding to the above formula will be that ranging from about 0.2 to about 0.5 weight percent based upon 100 parts by weight of the final mixture.

As disclosed hereinabove, the present invention particularly is applicable to the preparation of compacted or molded articles of blended mixtures of at least two different finely divided metals such as disclosed in U.S. Pat. No. 3,592,637. Thus, the teachings of this patent relating to such blended mixtures and their preparation are incorporated herein in their entirety by reference. In this regard, the present invention is most applicable to the preparation of compacted or molded articles of those blended mixtures suitable for addition to baths of molten aluminum and particularly those blended mixtures comprising finely divided manganese and aluminum metals. In such blended mixtures, the finely divided manganese and aluminum metals correspond to what this reference patent defines as the "principal material" and "solution promoter" material, respectively.

The process for preparing compacted or molded articles to which the improvement of this invention is applicable generally comprises providing the blended mixture of at least two different finely divided metals, introducing the blended mixture into a mold and then subjecting the blended mixture in said mold to a pressure sufficient to compress the blended mixture into the desired compacted or molded article.

Illustrative of a process to which the improvement of the present invention is applicable, is a process for preparing molded briquettes from a mixture of finely divided manganese metal and finely divided aluminum metal, said briquettes being suitable for addition to a bath of molten aluminum. Each of the finely divided manganese and aluminum metals first are ground to a size substantially smaller than about 20 mesh, i.e., less than about 840 microns and preferably smaller than about 40 mesh, i.e., less than about 420 microns. These finely divided metals then are combined by means of a suitable blending apparatus such as, for example, a zigzag-type blender in a ratio of about three parts by weight of manganese to about one part by weight of aluminum to form the blended mixture thereof. Concurrently with the blending of the two finely divided metals, i.e., the manganese and the aluminum metals, there is added to the blending apparatus about 0.5 part by weight based upon 100 parts by weight of the final mixture of a stabilizing and lubricating processing aid corresponding to the formula set forth hereinabove. The resulting admixture of said blended metals and processing aid then is discharged from said blending apparatus onto a roll press operating at pressures ranging from about 1500 to about 2500 pounds per square inch wherein the admixture is compressed or compacted into molded articles, e.g., briquettes. Typical of a roll press suitable for preparing briquettes from the resulting admixture is one comprising a pair of rotating drums positioned parallel to and spaced slightly apart from each other. Each drum contains in its respective surface multiple rows of indentations or hollows. The drums are rotated toward each other in such manner that at the spacial interface formed between the parallel drums, one row of indentations or hollows on one drum becomes oppositely opposed to one row of indentations or hollows on the other drum to form a series of multiple molds at this interface. Also, as the drums are rotated toward each other, a quantity of the admixture introduced onto the roll press is drawn into the spacial interface between the drums. As the admixture is drawn into this spacial interface, the admixture flows into and fills the oppositely opposed rows of indentations or hollows and undergoes compression into the desired solid briquette product. As the parallel drums of the roll press continue their rotation, the solid briquettes thus formed are released from the press and recovered on or in a suitable collection means, e.g., a conveyor, a hopper, or the like.

The following specific examples are for illustrative purposes only and are not intended or considered to limit the scope and application of the present invention.

EXAMPLES 1-3

Three separate admixtures comprising a blended mixture of finely divided manganese and aluminum metals to which is added a processing aid are prepared and compressed into briquettes. Each of the admixtures which is employed in these Examples consists of 75 percent by weight of 40 mesh or finer manganese powder, 24.5 percent by weight of 40 mesh or finer aluminum powder and 0.5 percent by weight of a liquid processing aid. The processing aids which are used in preparing the three admixtures include mineral oil (Example No. 1), ethylene glycol (Example No. 2) and PEG 400 (Example No. 3), a polyethylene glycol having a number average molecular weight of about 400. Example No. 1 and Example No. 2 are comparative examples and Example No. 3 is illustrative of the improvement comprising the present invention.

Blending of these powders and processing aids is carried out in a zigzag blender for a time sufficient to provide for complete homogenation of the admixture. Each of the three admixtures then are converted into briquettes having dimensions of about 1-19/16"×1-5/16"×9/16" utilizing a roll press such as described hereinabove and operated at a pressure of about 1500-2500 pounds per square inch(psi). Under this pressure, a temperature of about 65° C. is generated in the admixtures as they are compressed into the desired briquettes in the roll press. All three processing aids provide good stabilizing and lubrication properties to the admixtures.

Briquettes prepared from each of the admixtures then are tested to determine their dissolution rates and to observe any occurrence of flames or smoke as a result of the decomposition of the processing aids employed. The tests are carried out by adding the briquettes to a bath of molten aluminum metal being maintained at a temperature of about 760° C. Samples are taken at given intervals to determine the percent of manganese dissolved. The Table below contains data relating to this testing.

TABLE

| Example No. Processing Aid Time, Min. | 1 Mineral Oil | 2 Ethylene Glycol | 3 PEG 400[a] |
|---|---|---|---|
| | Percent Mn Dissolved | | |
| 5.0 | 88 | 70 | 90 |
| 7.5 | 92 | 76 | 95 |
| 10.0 | 96 | 85 | 98 |
| 15.0 | 99 | 91 | 100 |

[a]PEG 400 = polyethylene glycol having a number average molecular weight of about 400 and available from Union Carbide Corporation under the tradename Carbowax 400.

Observation of the surface of the bath of molten aluminum metal discloses that both flames and black smoke occur when the briquettes from Example No. 1 are added to the molten aluminum metal. The flames and black smoke are the result of the decomposition of the mineral oil processing aid present in the briquettes of this Example No. 1. No smoke formation and little or no flame generation are observed when the briquettes of Example No. 2 and Example No. 3 are added to the molten aluminum metal. However, as can be seen from the Table above, the use of ethylene glycol (comparative Example No. 2) as a processing aid causes a decrease in the dissolution rate of the manganese into the molten aluminum as compared to mineral oil. For this reason, ethylene glycol is considered to be unsuitable as a processing aid. Only the briquettes containing PEG 400 (Example No. 3), a polyglycol corresponding to the general formula set forth hereinabove, give dissolution rates comparable to those of the briquettes containing mineral oil.

While the invention herein has been described in terms of what at present are believed to be the preferred embodiments thereof, it is to be understood that this invention is not to be limited to these specific embodiments and that changes thereto may be made without departing from the spirit and scope thereof except as provided in the following claims.

What is claimed is:

1. In a process for manufacturing a compacted article of blends of additive metals for use in preparing an alloyed base metal said process including providing a blended mixture of at least two different finely divided additive metals, one of said additive metals being the same as the base metal, introducing said blended mixture into a mold and subjecting said blended mixture in said mold to a pressure sufficient to compress said blended mixture into said compacted article, the improvements which comprise:

providing at least one processing aid selected from a group consisting of liquid polyglycol materials and derivatives thereof, corresponding to the general formula:

$$RO(R^2O)_nR^1$$

wherein each of R and $R^1$ individually is hydrogen or a monovalent hydrocarbon radical selected from straight and branched-chain lower alkyl radicals and the radical $R^3CO$— where $R^3$ is a straight or branched-chain lower alkyl radical and where R and $R^1$ may or may not be the same; wherein $R^2$ is a divalent alkylene radical containing from two to four carbon atoms; wherein n is a number ranging from 2 to about 20 and admixing a stabilizing and lubricating amount of said processing aid with the blended mixture of additive metals prior to introducing the blended mixture of additive metals into said mold.

2. The improvements of claim 1 wherein the divalent alkylene radical, $R^2$, is selected from the radicals $—CH_2CH_2—$ and $—CH(CH_3)CH_2—$.

3. The improvements of claim 2 wherein each of said R and $R^1$ individually is hydrogen or a monovalent hydrocarbon radical selected from straight-chain and branched-chain lower alkyl radicals containing from one to about three carbon atoms and the radical $R^3CO$— where $R^3$ is selected from straight-chain and branched-chain lower alkyl radicals containing from one to about three carbon atoms.

4. The improvements of claim 3 wherein each of R and $R^1$ individually is hydrogen or a monovalent hydrocarbon radical selected from straight-chain alkyl and branched-chain lower radicals containing from one to about three carbon atoms.

5. The improvements of claim 4 wherein each of R and $R^1$ individually is hydrogen and n is a number ranging from 2 to about 18.

6. The improvements of claim 1 wherein the stabilizing and lubricating amount of the processing aid corresponding to said formula admixed with the blended mixture of finely divided additive metals ranging from about 0.1 to about 5.0 percent by weight based upon 100 parts by weight of the blended mixture and processing aid combined.

7. The improvements of claim 6 wherein the stabilizing and lubricating amount of the processing aid ranges from about 0.2 to about 0.5 percent by weight based upon 100 parts by weight of the blended mixture and processing aid combined.

* * * * *